US011896127B2

(12) United States Patent
Grabher et al.

(10) Patent No.: US 11,896,127 B2
(45) Date of Patent: Feb. 13, 2024

(54) FURNITURE DRAWER

(71) Applicant: Grass GmbH, Hoechst (AT)

(72) Inventors: Guenter Grabher, Fussach (AT); Patrick Pirker, Fussach (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 17/457,723

(22) Filed: Dec. 6, 2021

(65) Prior Publication Data

US 2022/0175137 A1 Jun. 9, 2022

(30) Foreign Application Priority Data

Dec. 9, 2020 (DE) ..... 20 2020 107 093.2

(51) Int. Cl.
*A47B 88/90* (2017.01)

(52) U.S. Cl.
CPC ..... *A47B 88/941* (2017.01)

(58) Field of Classification Search
CPC ..... A47B 88/941
See application file for complete search history.

(56) References Cited

U.S. PATENT DOCUMENTS 1,290,743 A * 1/1919 Herpst et al. ..... A47B 88/956 403/231
3,729,246 A * 4/1973 Harrell ..... A47B 88/941 312/348.2
4,277,122 A * 7/1981 Bargiel ..... A47B 88/941 312/348.1
5,180,217 A * 1/1993 Lautenschlager .... A47B 88/941 312/334.7
5,564,807 A * 10/1996 Rock ..... A47B 88/493 312/334.6
7,469,979 B2 * 12/2008 Tupper ..... E05B 65/462 312/348.4
2007/0159039 A1 * 7/2007 Lam ..... A47B 88/941 312/348.1
2014/0197724 A1 * 7/2014 Gasser ..... A47B 88/941 312/330.1
2018/0020832 A1 * 1/2018 Mason ..... A47B 88/40 312/334.1
2018/0206636 A1 * 7/2018 Held ..... A47B 88/956

FOREIGN PATENT DOCUMENTS

CN 110192731 * 9/2019 ..... A47B 99/90
DE 10-2017102644 * 8/2018 ..... A47B 88/913

* cited by examiner

*Primary Examiner* — James O Hansen
(74) *Attorney, Agent, or Firm* — BURR PATENT LAW, PLLC

(57) ABSTRACT

A metal furniture-drawer rear wall having a rectangular large surface-area element, an upper-side element and an attachment element. The large surface-area element has two broad side surfaces spaced apart and opposite one another, two long side surfaces spaced apart and opposite one another, and two narrow side surfaces spaced apart and opposite one another. The upper-side element is provided adjacent a long side surface, the attachment element is provided adjacent a narrow side surface, and the upper-side element and the attachment element extend in the direction of a surface normal to a broad side surface so that the furniture-drawer rear wall extends by less than 20 mm in this direction. The attachment element has an assembly mechanism in order to be connected directly to a furniture fitting by means of a connecting element.

6 Claims, 4 Drawing Sheets

FURNITURE DRAWER

This application claims the benefit under 35 USC § 119(a)-(d) of German Application No. 20 2020 107 093.2 filed Dec. 9, 2020, the entirety of which is incorporated herein by reference.

FIELD OF THE INVENTION

The present invention relates to a furniture-drawer rear wall, to a furniture fitting, and also to a furniture drawer having such a rear wall and such a furniture fitting.

BACKGROUND OF THE INVENTION

Drawer-assembly kits for attaching a rear wall to a drawer of a piece of furniture are known.

For example, drawer-assembly kits in which metallic drawer sidepieces and a drawer rear wall are connected in the first instance without any tools being used are known. The drawer rear wall is provided with appropriate elements for this purpose, as a result of which the drawer rear wall can be fitted, for example, onto the drawer sidepiece. Adapters by means of which the drawer rear wall can be, for example, clamped to the drawer sidepiece without any tool being used are also known.

The disadvantage with such assembly kits is that either they are comparatively costly or, as in the aforementioned example of the drawer rear wall being fitted on the drawer sidepiece, they require special tools in order to secure the drawer rear wall once fitted on the drawer sidepiece.

SUMMARY OF THE INVENTION

The present invention is based on the object of providing a comparatively cost-effective alternative for connecting a drawer rear wall to a drawer sidepiece.

The present invention can be seen in the provision of a furniture-drawer rear wall, wherein the furniture-drawer rear wall is formed from metal, wherein the furniture-drawer rear wall has a large surface-area element, an upper-side element and an attachment element, wherein the large surface-area element is of rectangular design, wherein the large surface-area element has two broad side surfaces, which are provided at a distance apart and opposite one another, wherein the large surface-area element has two long side surfaces, which are provided at a distance apart and opposite one another, wherein the large surface-area element has two narrow side surfaces, which are provided at a distance apart and opposite one another, wherein the upper-side element is provided adjacent to a long side surface, wherein the attachment element is provided adjacent to a narrow side surface, wherein the upper-side element and the attachment element extend in the direction of a surface normal to a broad side surface in such a manner that the furniture-drawer rear wall extends by less than 20 mm in this direction, wherein the attachment element has an assembly mechanism, in order to be connected directly to a furniture fitting by means of a connecting element. As a result, the furniture-drawer rear wall can be produced comparatively cost-effectively and can be attached to a drawer comparatively straightforwardly, flexibly and cost-effectively.

With the assembly arranged as intended, the furniture-drawer rear wall is a rear wall of a drawer of a piece of furniture. The furniture-drawer rear wall is advantageously formed exclusively from metal.

The upper-side element is advantageously provided on the long side surface, directly adjacent to the surface-area element. For example, the upper-side element is connected to the surface-area element via a bent-over portion. For example, the upper-side element and the surface-area element are integral with one another. It is also advantageous if the upper-side element is provided in a state in which it has been bent over in an L-shaped manner. This results in comparative improvements in the esthetic appearance of the furniture-drawer rear wall. Any risk of injury, in particular, from the furniture-drawer rear wall being installed, is likewise reduced as a result. Stability of the furniture drawer is also advantageously increased as a result. The upper-side element preferably extends over more than two thirds of a length of the surface-area element, in particular, over more than two thirds of a length of the furniture-drawer rear wall. The upper-side element advantageously extends over the entire length of the surface-area element, in particular, over the entire length of the furniture-drawer rear wall. The upper-side element, together with the surface-area element, preferably encloses a first cavity.

It is also conceivable for the furniture-drawer rear wall to have an underside element. For example, the underside element is arranged on the long side surface of the surface-area element, and, therefore, the underside element is provided opposite, and at a distance apart from, the upper-side element. A fastening mechanism is advantageously provided on the underside element, and, therefore, the underside element can be connected to a drawer base. For example, the underside element comprises the fastening mechanism.

The underside element is advantageously provided on the long side surface, directly adjacent to the surface-area element. For example, the underside element is connected to the surface-area element via a bent-over portion. For example, the underside element and the surface-area element are integral with one another. It is also advantageous if the underside element is provided in a state in which it has been bent over in an L-shaped manner. This results in comparative improvements in the esthetic appearance of the furniture-drawer rear wall. Any risk of injury, in particular, from the furniture-drawer rear wall being installed, is likewise reduced as a result. Stability of the furniture drawer is also advantageously increased as a result. The underside element preferably extends over more than two thirds of a length of the surface-area element, in particular, over more than two thirds of a length of the furniture-drawer rear wall. The underside element advantageously extends over the entire length of the surface-area element, in particular, over the entire length of the furniture-drawer rear wall. For example, the underside element, together with the surface-area element, encloses a second cavity.

The attachment element is advantageously provided on the narrow side surface, directly adjacent to the surface-area element. For example, the attachment element is connected to the surface-area element via a bent-over portion. For example, the attachment element and the surface-area element are integral with one another. It is also advantageous if the attachment element is provided in a state in which it has been bent over in an L-shaped manner. This results in comparative improvements in the esthetic appearance of the furniture-drawer rear wall. Any risk of injury, in particular, from the furniture-drawer rear wall being installed, is likewise reduced as a result. Stability of the furniture drawer is also advantageously increased as a result. The attachment element preferably extends over more than two thirds of a height of the surface-area element, in particular, over more than two thirds of a height of the furniture-drawer rear wall.

The attachment element advantageously extends over the entire height of the surface-area element, in particular, over the entire height of the furniture-drawer rear wall. For example, the attachment element, together with the surface-area element, encloses a third cavity.

It also proves to be advantageous for the furniture-drawer rear wall to have two attachment elements, wherein the two attachment elements are provided at a distance apart from one another on the respectively opposite narrow side surfaces of the surface-area element.

The upper-side element and the attachment element are advantageously arranged on the surface-area element in a state in which they have been bent over in the same direction. Both the upper-side element and the attachment element preferably extend over less than 20 mm in this direction.

The assembly mechanism is preferably provided in the form of an opening or in the form of a through-bore in the attachment element. For example, the attachment element comprises an aperture in the form of the assembly mechanism. The attachment element advantageously comprises two, three, four or more assembly mechanisms. It is conceivable for the assembly mechanisms to be designed in such a manner that, with the assembly arranged as intended, the connecting element engages through the assembly mechanism. The attachment element is advantageously provided on the furniture-drawer rear wall such that, with the assembly arranged as intended, the connecting element projects into the third cavity. For example, with the assembly arranged as intended, the connecting element is located on the assembly mechanism at least to some extent in the third cavity.

It likewise proves to be advantageous for the assembly mechanism to be designed to receive a screw or a rivet. The assembly mechanism is preferably designed so that the connecting element can be arranged thereon, in particular, can be fastened thereon. It is also advantageous for the assembly mechanism to have a thread.

In an advantageous modification, the furniture-drawer rear wall extends by less than 11 mm in the direction of a surface normal to the broad side surface.

The surface-area element advantageously has a broad side surface extending along a length of the furniture-drawer rear wall and along a height of the furniture-drawer rear wall and has a long side surface extending along the length of the furniture-drawer rear wall and along a width of the furniture-drawer rear wall and has a narrow side surface extending along the height of the furniture-drawer rear wall and along the width of the furniture-drawer rear wall.

The furniture-drawer rear wall advantageously extends over less than 20 mm in the width direction. For example, the furniture-drawer rear wall extends over 19 mm, 18 mm, 16 mm, 14 mm, 12 mm, 10.4 mm, 10 mm, 9 mm, 8.3 mm or 8 mm in the width direction. For example, the furniture-drawer rear wall extends over less than 20 mm, less than 18 mm, less than 16 mm, less than 14 mm, less than 12 mm, less than 11 mm, less than 10.4 mm, less than 10 mm, less than 9 mm or less than 8.3 mm in the width direction.

In an advantageous embodiment, the furniture-drawer rear wall extends over precisely 8.3 mm in the direction of a surface normal to the broad side surface.

It is also proposed that the furniture-drawer rear wall should be formed in one piece. All the components of the furniture-drawer rear wall are advantageously integral with one another. It is conceivable for the furniture-drawer rear wall to be punched out of a metal panel and bent over.

It is also proposed that the furniture-drawer rear wall should be produced from a metal panel which has a wall thickness of less than or equal to 1.5 mm, in particular less than or equal to 1 mm. The width of the surface-area element advantageously corresponds to the wall thickness of the metal panel. For example, the width of the surface-area element, and, therefore, the distance between the two broad side surfaces in the direction of the surface normal to the side surfaces, is smaller than or equal to 1.5 mm, in particular smaller than or equal to 1 mm.

A further advantageous embodiment of the present invention is constituted by a furniture fitting, wherein the furniture fitting is designed to connect a drawer side wall to a furniture-drawer rear wall, wherein the furniture fitting has an assembly element, wherein the assembly element is provided in the form of a through-opening in the furniture fitting, and therefore, in the assembled state, a connecting element engages through the assembly element and acts on an assembly mechanism of the furniture-drawer rear wall, and, therefore, the furniture fitting is connected directly to the furniture-drawer rear wall by means of the connecting element.

The furniture fitting is advantageously designed in the form of a corner upright of the furniture drawer.

The assembly element is preferably provided in the form of an opening or in the form of a through-bore in the furniture fitting. For example, the furniture fitting comprises an aperture in the form of the assembly element. The furniture fitting advantageously comprises two, three, four or more assembly elements. The furniture fitting is advantageously designed such that, with the furniture-drawer rear wall arranged on the furniture fitting, the connecting element projects into the third cavity of the furniture-drawer rear wall.

It likewise proves to be advantageous for the assembly element to be designed to receive a screw or a rivet. The assembly element is preferably designed so that the connecting element can be arranged thereon, in particular, can be fastened thereon. It is also advantageous for the assembly element to have a thread.

A further advantageous variant of the present invention is constituted by a furniture drawer comprising a furniture fitting according to one of the aforementioned embodiments and a furniture-drawer rear wall according to one of the aforementioned embodiments, and also a connecting element, wherein the furniture-drawer rear wall is connected directly to the furniture fitting by means of the connecting element, wherein the connecting element is designed in the form of a screw or in the form of a rivet.

In an advantageous embodiment of the present invention, the connecting element is designed in the form of a self-tapping screw.

When arranged on the furniture drawer, the furniture-drawer rear wall is preferably arranged, in particular, so as to bear directly on the furniture fitting.

BRIEF DESCRIPTION OF THE DRAWINGS

A number of exemplary embodiments will be explained with reference to the following schematic drawings, with information being given in relation to further details and advantages.

DETAILED DESCRIPTION OF THE INVENTION

Figure 1:
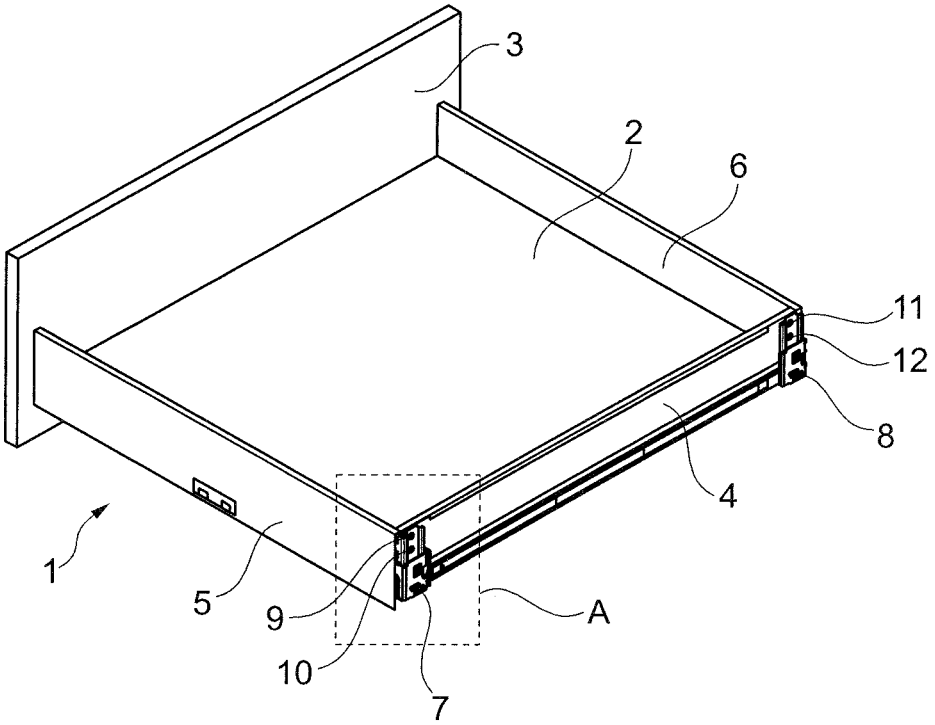
FIG. 1 shows a perspective view, as seen obliquely from the side, from the rear and from above, of a furniture drawer according to the present invention with a furniture fitting, furniture-drawer rear wall and connecting element arranged in place.

FIG. 1 shows a furniture drawer 1 according to the present invention. The figure shows that the furniture drawer 1 has a furniture-drawer base 2, a furniture-drawer front 3, a furniture-drawer rear wall 4, furniture sidepieces 5, 6, furniture fittings in the form of corner uprights 7, 8, and connecting elements in the form of screws 9 to 12.

Figure 2:
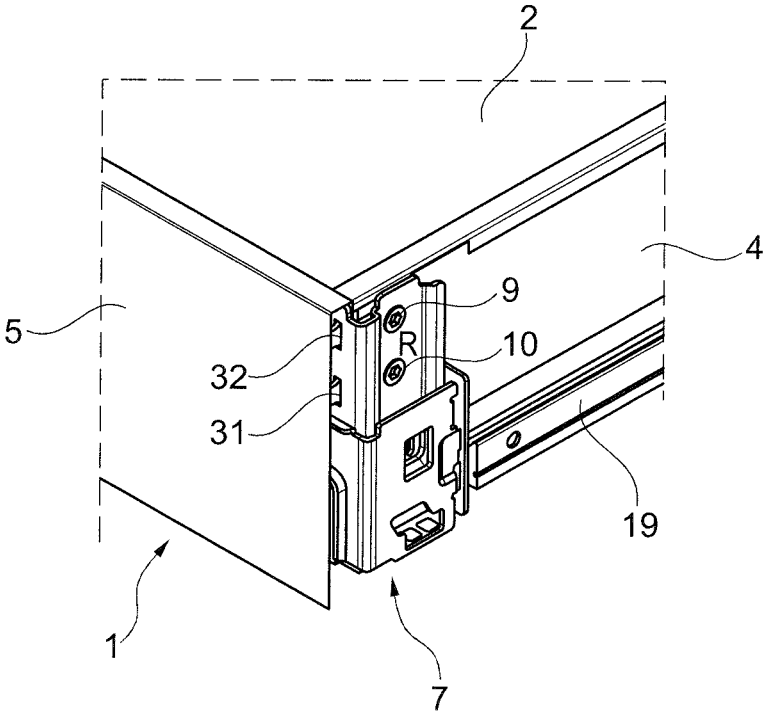
FIG. 2 shows an enlarged detail of the furniture drawer according to FIG. 1.

FIG. 2 is an enlarged illustration of detail A of the furniture drawer 1 from FIG. 1. The corner upright 7 connects the furniture sidepiece 5 to the furniture-drawer rear wall 4. The corner upright 7 here is connected to the furniture-drawer rear wall 4 by means of the screws 9, 10. The screws 9, 10 here engage through assembly means in the form of through-bores (not shown, concealed by heads of the screws 9, 10) in the corner upright 7.

Figure 3:
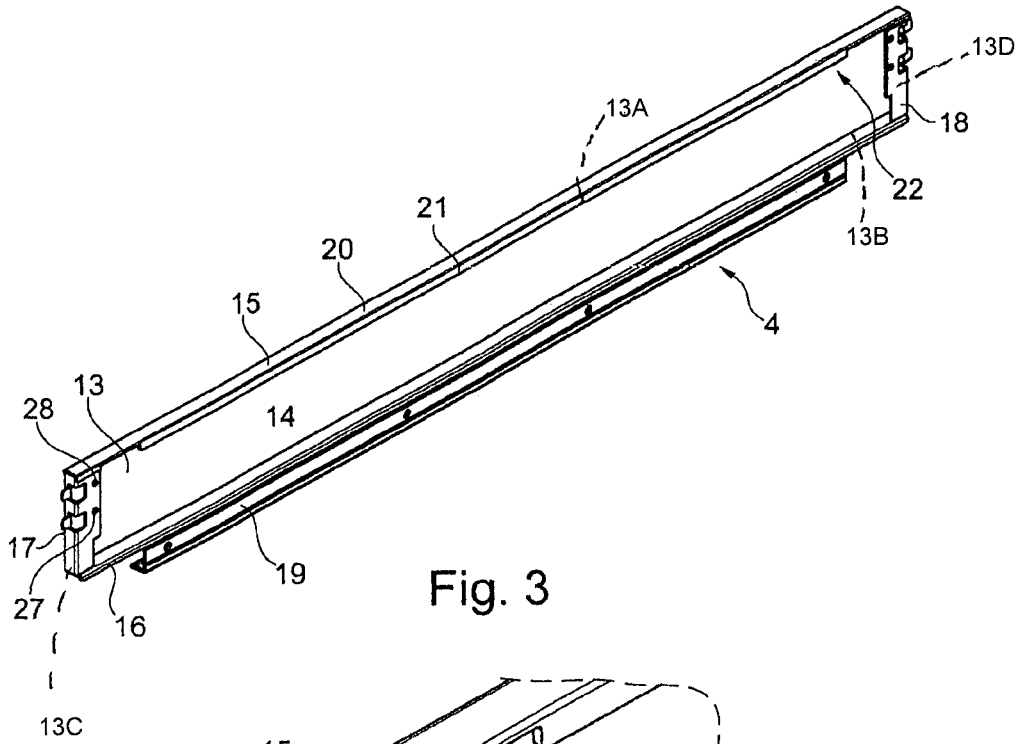
FIG. 3 shows a perspective view, as seen obliquely from the side, from the rear and from above, of a furniture-drawer rear wall according to FIG. 1.
Figure 4:
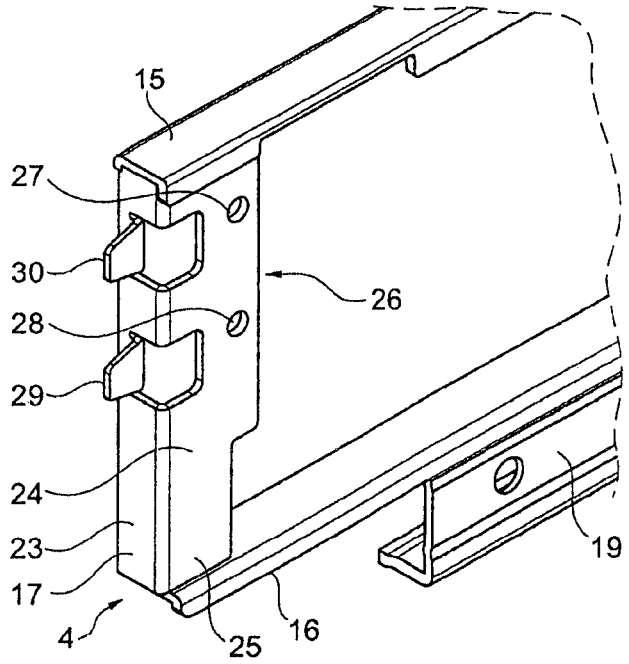
FIG. 4 shows an enlarged detail of the furniture-drawer rear wall according to FIG. 3.

The furniture-drawer rear wall 4 has a rectangular surface-area element 13 with six surfaces, including two opposed broad side (i.e., a front face and a back face) surfaces, wherein FIGS. 1 to 4 show one of the two opposed broad side surfaces 14. The rectangular element 13 also includes an upper-side surface 13A and an opposed underside surface 13B (i.e., two long side surfaces), and opposed first and second end surfaces (i.e., two narrow side surfaces) 13C, 13D, respectively. The furniture-drawer rear wall 4 also has an upper-side element 15, an underside element 16 and two attachment elements 17, 18 (FIG. 3). A fastening mechanism 19 is provided on the underside element 16, adjacent to the latter, and is designed to connect the furniture-drawer rear wall 4 to the furniture-drawer base 2.

The surface-area element 13, the upper-side element 15, the underside element 16 and the attachment elements 17, 18 are advantageously provided in one piece. It is also conceivable for the fastening mechanism 19 to be formed in one piece with the surface-area element 13, the upper-side element 15, the underside element 16 and the attachment elements 17, 18.

The upper-side element 15 is advantageously of L-shaped design and extends along a longitudinal extent of the furniture-drawer rear wall 4. The upper-side element 15 preferably has an upper side 20 forming an upper, in particular visible, termination of the furniture-drawer rear wall 4. The upper side 20 advantageously extends along, in particular, the entire length of the furniture-drawer rear wall 4 and along a width of the furniture-drawer rear wall 4. The upper side 20 preferably extends over less than 20 mm in the width direction. The width of the furniture-drawer rear wall 4 is advantageously defined by the width extent of the upper side 20. For example, the upper-side element 15 comprises a bracket element 21, which is provided on the upper side 20 in a state in which it has been bent over, and, therefore, the upper side 20, together with the bracket element 21, define an L shape of the upper-side element 15. In particular, the upper side 20, the bracket element 21 and the surface-area element 13 enclose a first cavity 22.

The attachment element 17 is advantageously of L-shaped design. For example, the attachment element 17 extends along a height extent of the furniture-drawer rear wall 4 and along the width extent. The attachment element 17 advantageously comprises a first angle element 23 and a second angle element 24. For example, the first angle element 23 is provided on the surface-area element 13 in a state in which it has been bent over on a first side and the second angle element 24 is provided in a state in which it has been bent over on a second side of the angle element 23, wherein the first side and the second side are provided opposite one another, and at a distance apart from one another, on the first angle element 23. The angle elements 23 and 24 advantageously form an L shape.

For example, the second angle element 24 has an inner side and an outer side 25, wherein the inner side is provided opposite, and at a distance apart from, the outer side 25. The inner side of the second angle element 24 is advantageously provided opposite, and at a distance apart from, the side surface 14 of the surface-area element 13, and, therefore, the surface-area element 13, the first angle element 23 and the second angle element 24 enclose a further cavity 26.

Assembly mechanisms in the form of through-bores 27, 28 are preferably provided in the second angle element 24. The screws 9, 10 can advantageously be secured in the through-bores 27, 28, and, therefore, with the furniture drawer 1 arranged as intended, e.g. according to FIG. 1, the furniture sidepiece 5 can be connected to the furniture-drawer rear wall 4 via the corner upright 7 and the screws 9, 10. The corner upright 7 can advantageously be connected directly to the second angle element 24, and, therefore, to the furniture-drawer rear wall 4, via the screws 9, 10. It proves to be advantageous here if, with the assembly arranged as intended, the screws 9, 10 have one end projecting into the further cavity 26. As a result, the screws are concealed by the surface-area element 13 such that a person using the drawer cannot see them. The screws 9, 10 are advantageously designed, and can be arranged on the furniture drawer 1, such that, with the assembly arranged as intended, the screws 9, 10 are not in contact with the side surface 14.

For example, lugs 29, 30 are punched out of the first angle element 23 and, when the assembly is arranged as intended, the lugs are used to fit the furniture-drawer rear wall 4 into the corner upright V.

What has been said above in relation to the attachment element 17 and the corner upright 7 advantageously applies, in mirror-inverted fashion, to the attachment element 18 and to the corner upright 8.

Figure 5:
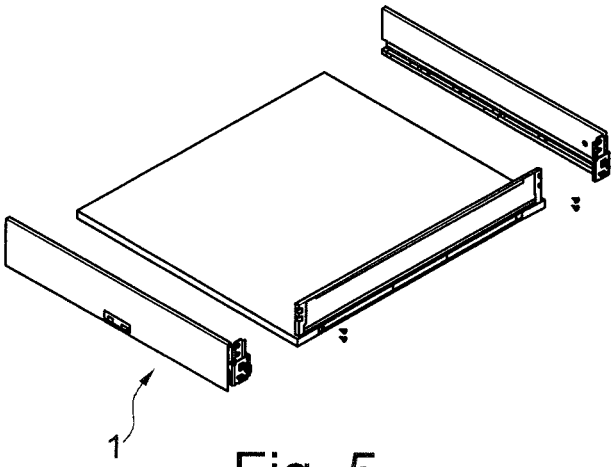
FIGS. 5 to 7 show a perspective view, as seen obliquely from the side, from the rear and from above, of a furniture drawer in different assembly situations, the furniture-drawer front not being shown.
Figure 6:
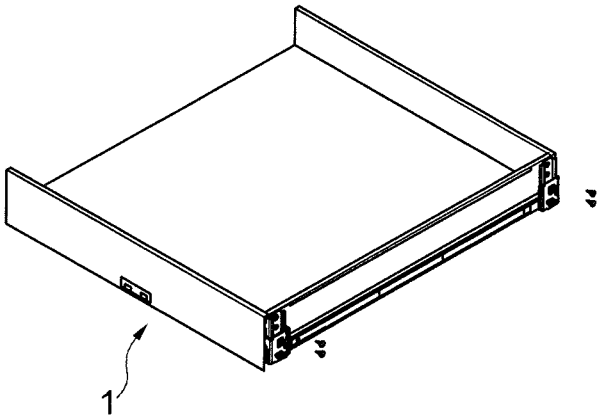
Figure 7:
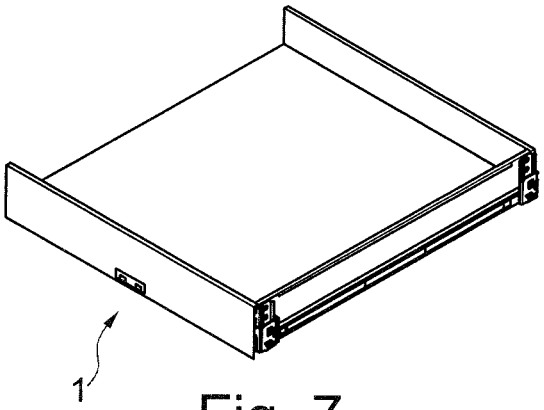

FIGS. 5 to 7 illustrate a variant of an assembly operation for the furniture drawer 1, the furniture-drawer front 3 having been omitted. First of all, the furniture sidepieces 5, 6 are connected to the corner uprights 7, 8. Then, the furniture sidepieces 5, 6 are fitted together with the furniture-drawer base 2 and the furniture-drawer rear wall 4, and, therefore, the furniture-drawer rear wall 4 has its lugs 29, 30 fitted in corresponding mounts 31, 32 (FIG. 2) on the corner uprights 7, 8. Then, the corner uprights 7, 8 are screwed to the furniture-drawer rear wall 4 by means of the screws 9 to 12. This provides for comparatively straightforward assembly of the furniture drawer 1.

Figure 8:
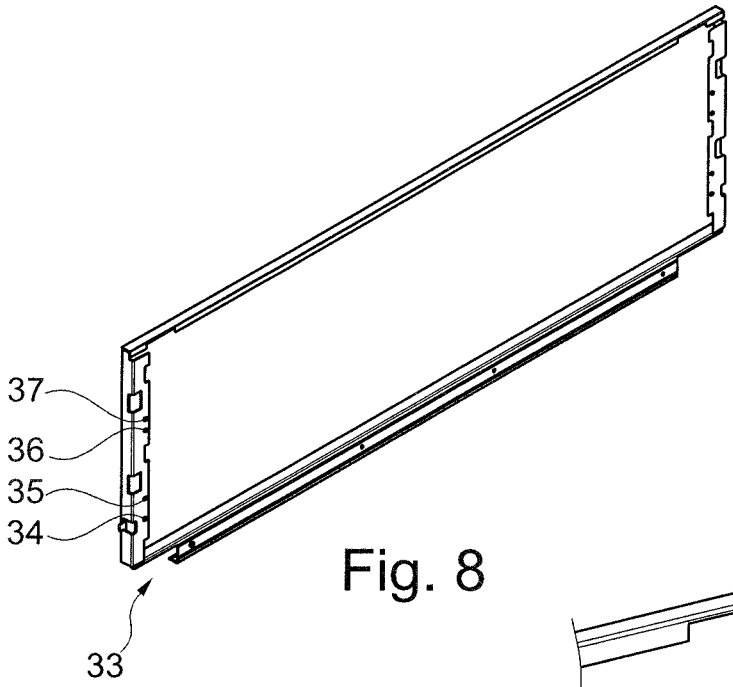
FIG. 8 shows a perspective view, as seen obliquely from the side, from the rear and from above, of a further variant of a furniture-drawer rear wall.
Figure 9:
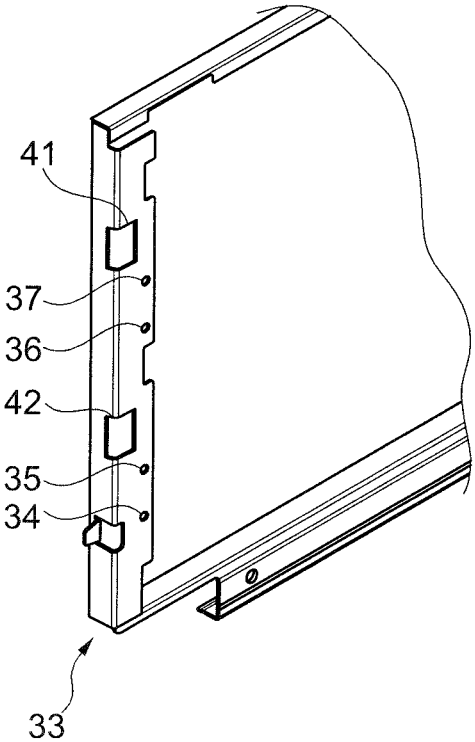
FIG. 9 shows an enlarged detail of a left-hand side of the furniture-drawer rear wall according to FIG. 8.
Figure 10:
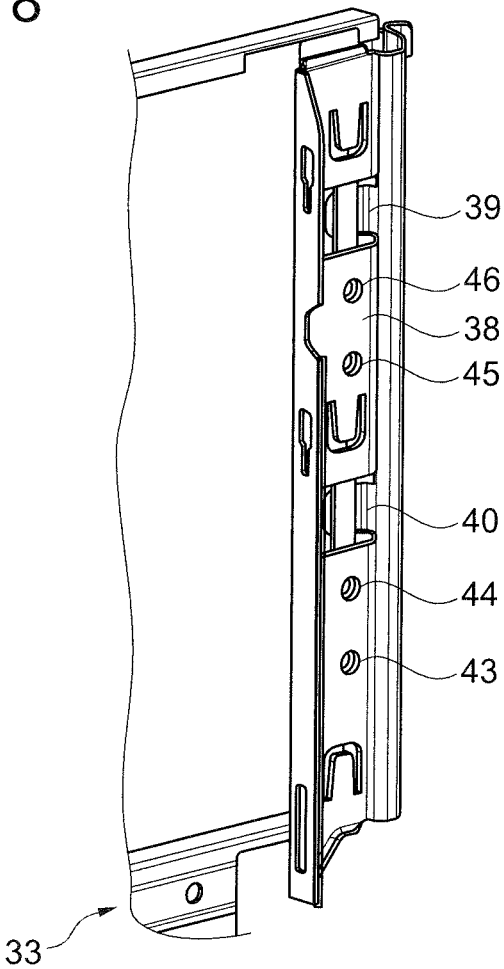
FIG. 10 shows an enlarged detail of a right-hand side of the furniture-drawer rear wall according to FIG. 8, a further variant of a furniture fitting being arranged on the furniture-drawer rear wall.

FIGS. 8 to 10 show a further embodiment of a furniture-drawer rear wall 33. The furniture-drawer rear wall 33 differs from the furniture-drawer rear wall 4 discussed above essentially in terms of height, and, therefore, the furniture-drawer rear wall 33 is higher than the furniture-drawer rear wall 4. For example, for this reason, the furniture-drawer rear wall 33 comprises more assembly mechanisms in the form of through-bores 34 to 37.

FIG. 10 shows a corner upright 38 arranged in a preassembly state on the furniture-drawer rear wall 33. The figure shows that the corner upright 38 is fitted by means of lugs 39, 40 in openings 41, 42 in the furniture-drawer rear wall 33. FIG. 10 also shows that the corner upright 38 has assembly elements 43 to 46, which are designed in the form of through-bores, in order for a connecting element to be arranged therein.

LIST OF REFERENCE SIGNS

1 Furniture drawer
2 Furniture-drawer base
3 Furniture-drawer front
4 Furniture-drawer rear wall
5 Furniture sidepiece
6 Furniture sidepiece
7 Corner upright
8 Corner upright
9 Screw
10 Screw
11 Screw
12 Screw
13 Surface-area element
14 Side surface
15 Upper-side element
16 Underside element
17 Attachment element
18 Attachment element
19 Fastening mechanism
20 Upper side
21 Bracket element
22 Cavity
23 Angle element
24 Angle element
25 Outer side
26 Cavity
27 Through-bore
28 Through-bore
29 Lug
30 Lug
31 Mount
32 Mount
33 Furniture-drawer rear wall
34 Through-bore
35 Through-bore
36 Through-bore
37 Through-bore
38 Corner upright
39 Lug
40 Lug
41 Opening
42 Opening
43 Assembly element
44 Assembly element
45 Assembly element
46 Assembly element

The invention claimed is:

1. A metal furniture-drawer rear wall comprising:
a rectangular element;
an upper-side element;
an under-side element; and
an attachment element,
wherein the rectangular element has six surfaces including a front face and an opposed back face spaced apart from one another, an upper-side surface and an opposed underside surface spaced apart from one another, and a first end surface and an opposed second end surface spaced apart from one another,
wherein the upper-side element is directly connected to the upper-side surface,
wherein the attachment element is directly connected to at least one of the first and second end surfaces,
wherein the upper-side element and the attachment element extend in a first direction that runs perpendicular with respect to the opposed front and back faces of the rectangular element, so that the furniture-drawer rear wall extends by less than 20 mm in the first direction,
wherein the upper-side element is bent over in an L-shaped manner and extends over more than two thirds of a length of the rectangular element,
wherein the under-side element is directly connected to the underside surface,
wherein the under-side element extends from a front side to a back side of the furniture-drawer rear wall,
wherein the under-side element comprises a fastening mechanism that is bent over in an L-shaped manner,
wherein the fastening mechanism directly contacts and is integral with respect to the under-side element,
wherein the fastening mechanism extends from a back side of the furniture-drawer rear wall proximate an end of the under-side element opposing the underside surface end of the under-side element toward a front side of the furniture-drawer rear wall to accommodate a drawer bottom,
wherein the fastening mechanism does not extend more than 20 mm in the first direction,
wherein the attachment element is adapted to be connected directly to a furniture fitting via a connecting element, and
wherein the metal furniture-drawer rear wall is a unitary body formed in one piece.

2. The furniture-drawer rear wall according to claim 1, wherein the attachment element comprises an assembly mechanism having an opening or a through-bore.

3. The furniture-drawer rear wall according to claim 2, wherein the opening or through-bore of the assembly mechanism has a thread.

4. The furniture-drawer rear wall according to claim 1, wherein the furniture-drawer rear wall extends by less than 11 mm in the first direction.

5. The furniture-drawer rear wall according to claim 1, wherein the furniture-drawer rear wall extends over precisely 8.3 mm in the first direction.

6. The furniture-drawer rear wall according to claim 1, wherein the furniture-drawer rear wall comprises a metal panel having a wall thickness that is less than or equal to 1.5 mm.

* * * * *